United States Patent [19]

Ferrage et al.

[11] Patent Number: 4,787,157

[45] Date of Patent: Nov. 29, 1988

[54] DRYER AND IRONER WITH DEFORMABLE TROUGH

[75] Inventors: François Ferrage, La Riviere-de-Corps; Michel Adler, Bouilly, both of France

[73] Assignee: Etablissements DUBIX (S.A.), Saint-Julien-Les-Villas, France

[21] Appl. No.: 854,140

[22] Filed: Apr. 21, 1986

[30] Foreign Application Priority Data

Apr. 23, 1985 [FR] France ..... 85 06199

[51] Int. Cl.[4] ..... D06F 65/06; D06F 67/08

[52] U.S. Cl. ..... 38/56; 38/47; 34/124

[58] Field of Search ..... 38/47, 56, 66, 52, 53; 34/119, 124; 100/156

[56] References Cited

U.S. PATENT DOCUMENTS

| | | | |
|---|---|---|---|
| 3,118,240 | 1/1964 | D'Hooge | 38/56 |
| 3,170,256 | 2/1965 | Jesus | 38/56 |
| 3,516,184 | 6/1970 | Oberley | 38/56 |
| 4,554,752 | 11/1985 | Bosshart et al. | 38/56 X |

*Primary Examiner*—Andrew M. Falik
*Assistant Examiner*—C. Whitfield
*Attorney, Agent, or Firm*—Larson & Taylor

[57] ABSTRACT

The outside convex surface of the bent plate forming the trough of a rotating cylinder type ironing machine is carved with two grooves which run parallel to its bending axis and divide the trough into three equal curved sectors. Each of these grooves providing, by reduction of the thickness of the said plate, an axis of less resistance of the latter to bending, such that the adjustable supports of the trough against the outer lining wrapping the rotating cylinder of the machine by the slight bending of the trough occurring along each of the said grooves, regardless of the temperature and the expansion of the trough.

10 Claims, 8 Drawing Sheets

30
32
56
18
20
33
34
46
21
15
22
38
19
29
28
35
31
45
36
44
56

88
47
86
18
48
49
81
21
75
50
15
51
19
76
22
55
89
20
87
82
59
54
53
67
29
28
65
59
71
52
69

88
47
86
18
48
49
81
21
50
75
15
51
19
52
22
57
89
87
55
20
43
82
54
53
41
29
28
71
42
76
57

DRYER AND IRONER WITH DEFORMABLE TROUGH

FIELD OF THE INVENTION the present invention relates to a drying and ironing machine with an improved trough.

BACKGROUND OF THE INVENTION

The term "drying and ironing machine with a trough" is to be understood as meaning a machine in which a flat piece of fabric, still damp (generally after completion of the wash and spin dry cycle of a washing machine) and drawn by a rotating cylinder, is dried and ironed by friction against the polished inner surface of a heated trough, generally of semi-cylindrical shape, against which the rotating cylinder applies it. By analogy with domestic ironing, one may say that in this machine it is the fixed trough which plays the part of the flat-iron while the rotating cylinder plays the part of the ironing table.

The heated trough rises to a temperature of about 200° C. by such means as the circulation of pressured steam and heats, by contact, the damp piece of fabric and dries it by vaporization of the residual water impregnating it, while ironing it by friction on this surface.

The cylinder is perforated over its whole cylindrical surface by a large number of openings and this cylindrical surface is completely wrapped by a sleeve-like elastic and permeable outer lining substituting for the table felt used in domestic ironing. This elastic lining ensures the uniform application of the piece of fabric against the polished inner surface of the trough as the piece of fabric travels along the trough.

The steam resulting from the vaporization of the residual water impregnating the piece of fabric passes through this outer lining and penetrates into the inside of the cylinder through its openings from where it is evacuated by suction.

It can easily be understood that the quality of the ironing depends upon the uniformity of the pressure of application of the piece of fabric along its whole length against the surface of the trough. Now, this uniformity is only achievable if the cylinder and the polished inner surface of the heated trough remain coaxial at ironing temperature. Both being coaxial in the cold state and the polished inner surface of the heated trough remaining applied to the cylinder through the piece of fabric pressed against the cylinder outer lining, this cylinder and the said polished surface can no longer be coaxial at ironing temperature due to their different rates of expansion, as follows:

the cylinder and the trough have heat expansion coefficients which are similar or equal since both are made of rolled boiler-type steel sheet metal. But, while the entire polished inner surface of the trough remains permanently heated to about 200° C., only a portion of the cylinder is exposed, at the time, to this heated surface of the trough through the cylinder outer lining, thus making the trough much warmer and expanded than the cylinder during full operation of the drying and ironing machine;

while the cylinder is a closed surface, the inner surface of the trough is an opened one which features exposed edges and which, since it is made by the bending of boiler-type steel sheet metal which creates permanent stress within the metal, is therefore subject to internal temperature variations which results, at any given heating temperature, in a greater increase of its radius of curvature than if it was carved out of homogeneous steel block free of internal stress, a circumstance which does not apply to the cylinder even though it is also made of bent boiler-type steel sheet metal, owing to continuous nature of its surface;

the preferred use of pressured steam, as a means to heat the trough, itself tends to increase the radius of curvature of the (heating) polished inner surface of the trough, due to the pressure created by the steam upon such surface.

It follows that, during the operation mode of the machine, the curvature of the heating polished inner surface of the trough is substantially less than that of the cylinder with its outer lining and that this inner (concave) surface of the trough progressively separates itself from the face of the cylinder as it nears the horizontal diameter of the cylinder where it creates a gap ("e" in FIG. 3) which is obviously proportional, in size, to the diameter of the cylinder of the machine.

In appliances with small cylinder diameter, the resilience alone of the cylinder outer lining, while not achieving the uniformity of pressure aimed as above, is sufficient, however, to keep this pressure substantially uniform along the inner surface of the trough.

In appliances with larger cylinder diameter (i.e. some tens of centimeters) one has recourse to the following expedient: between the cylinder and its outer lining is placed a large number of small springs acting radially and which keep, via the cylinder outer lining, the piece of fabric pressed against the heated inner (concave) surface of the trough, these radial springs becoming increasingly compressed the more they approach the lower part of the said inner surface of the trough. This solution, however, has the drawback of subjecting the cylinder outer lining to variable stresses which accelerate its aging as well as its wear and tear, and to permanently strain the springs which, by being located in a humid environment, can deteriorate in an unpredictable way.

In appliances with still larger cylinder diameter (more than 100 cm) and such as the type referred to in this invention, the above-mentioned expedient, already open to criticism in itself, proves to be unapplicable, since the then oversized gap "e" mentioned above can no longer be compensated by this means.

For machines of this latter type, one could conceive several ways to compensate or eliminate this gap "e".

One could think of sizing, in the cold state, the inner (concave) surface of the trough to a lesser diameter than that of the cylinder with its outer lining and such that, the trough being brought to ironing temperature and expanding thereafter, these diameters come to match each other. However, since this solution would require the maintenance of a well-defined ironing temperature to keep the trough relatively free from the cylinder in the cold state, it would prove to be unfeasible.

One could also try to eliminate the said gap by undersizing the diameter of the inner (concave) surface of the trough relative to that of the cylinder with its lining. However, this would generate substantial lateral forces hindering the rotation of the cylinder to the point of blocking its movement.

Last, one could try to reduce this gap "e" by dividing the surface of the trough into several curved and articulated sectors, hinged lengthwise to one another. For n equal sectors the gap "e" would thus be reduced to "e"/n and therefore be smaller as one increases the number of these equal sectors. However, this solution would have the drawback of producing, at each articulation between two sectors, a discontinuity of the inner (concave) surface of the trough on which the front edge of the piece of fabric would butt against, and jam the machine. In addition, each of the said articulations could corrode, considering the damp environment in which the trough operates. Some of the articulations could then lock in unpredictable positions and disrupt the regularity of the curvature of the inner (concave) surface of the trough.

SUMMARY OF THE INVENTION

Provided with a trough featuring a continuous inner (concave) surface, and having the advantages offered by the last solution, without having the drawbacks of solutions mentioned above, the drying and ironing machine with an improved trough according to the invention comprises (in known manner per se) a rotating cylinder the whole cylindrical surface of which is perforated by a large number of openings and completely wrapped by a sleeve-like elastic and permeable outer lining, and a trough, heated to ironing temperature and against the inner concave and polished surface of which a piece of fabric, drawn by the rotating cylinder and its lining, is applied and simultaneously dried and ironed by friction.

According to the main feature of the invention, the said inner concave and polished surface is that of a rectangular metal plate, such as of boiler-type steel sheet metal, which is bent to a radius approximately equal to that of the cylinder with its outer lining when cold, and which is carved on its outside convex surface, by such means as power drilling, with grooves running parallel to the bending axis of this plate and dividing the trough into several equal rigid curved sectors the number of which is equal to the number of the grooves plus one, each of these grooves providing, by reduction of the thickness of the said plate, an axis of less resistance to the bending of the trough, and the machine includes adjustable supports of the trough which ensure the tight fit of each of the said sectors of the trough against the outer lining of the rotating cylinder by the slight bending of the trough occurring along each of the said grooves, irregardless of the temperature and the expansion of the trough.

According to another feature of the invention, each end of the trough sectors carries a flat and curvilinear reinforcing bracket fastened over its entire length to the outer convex surface of the said plate, by such means as a continuous weld, and positioned so that the overall profile of all reinforcing brackets of adjacent sectors form at each of the two ends of the trough a half rim bracing this end of the trough.

According to another feature of the invention, the reinforcing brackets forming a given half rim are linked by means of a free travel limiting device which restricts the distance between two continuous reinforcing brackets within a predetermined range, therefore limiting the length of the half rim and the curvature of the trough.

According to another feature of the invention, the adjustable supports of the trough are two lateral beams located on either side of the trough, each one carried at each of its two ends by a pneumatic jack and upon which rest, by means of shoulder pieces, the terminal reinforcing brackets of the corresponding ends of the two half rims.

According to another feature of the invention, each sector of the trough is provided with a fluid circulating heating system, such as pressured steam type, made of several faceted channels which overlap sidewise so as to communicate with one another, each of those channels covering and being welded to a portion of the outside surface of each trough sector while fitting, lengthwise, between the two half rims of the trough, and the heating systems of the trough sectors are connected by means of flexible conduits which can absorb the slack resulting from the bending of the trough along the said grooves.

Advantageously, the faceted channels which back any given trough sector are hugged by flat and annular reinforcing brackets, each welded to the back of the said channels and positioned across the outside face of adjacent trough sectors so that they line up with one another in order to form a segmented half rim.

According to a preferred embodiment of the invention, the trough of the machine includes only three equal sectors and the heating systems of the two outer sectors are fed, in parallel, with pressured steam by means of a curved supply conduit, and communicate with the heating system of the third or intermediary sector through four U-shape conduits which are folded back against the back of the trough, the steam being evacuated from the latter heating system to a condenser by means of a return conduit.

The invention will be better understood and other features thereof will be clarified by referring to the following description and accompanying drawings which relate to a preferred embodiment of the drying and ironing machine with an improved trough in accordance with the said invention, comprising only three trough sectors and given by way of a non-limiting example of construction.

DESCRIPTION OF THE PREFERRED EMBODIMENT

Figure 1:
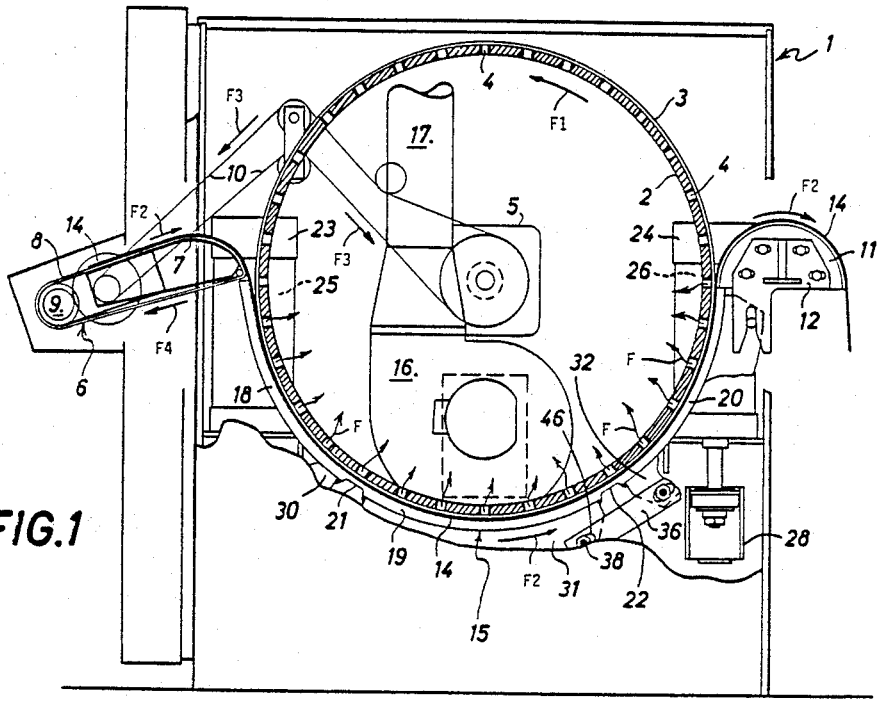
FIG. 1 shows a diagrammatic side view of the drying and ironing machine with an improved trough, according to this preferred embodiment of the invention.

As shown in FIG. 1, the drying and ironing machine 1 according to the invention comprises, in known manner, a rotating cylinder 2, the whole cylindrical surface of which is perforated by a large number of openings 4 and completely wrapped by a sleeve-like elastic and permeable outer lining 3. This rotating cylinder 2 is driven by a motor 5 and rotates in the direction of the arrow Fl. Moreover, the machine 1 comprises a trough 15, heated to ironing temperature (about 200° C.) and against the inner concave and polished surface of which a piece of fabric 14, drawing in the direction of the arrows F2 by the rotating cylinder 2 and its outer lining 3, is applied and simultaneously dried and ironed by friction. A feeder 6 with an endless band 8 stretched around a frame 7 and driven by a roller 9 in the direction of the arrow F4 feeds the said piece of fabric 14 between the lining 3 of the rotating cylinder 2 and the said inner concave and polished surface of the trough 15. The roller 9 is driven by friction of another roller rotated by a belt 10 driven, in the direction of the arrow F3, by the motor 5. After the piece of fabric 14 is dried and ironed, it leaves the machine 1 via the outlet 11 which is provided with a coupling member 12 permitting the association of the said machine with a second one, not shown. During the drying and ironing operation, the residual water impregnating the piece of fabric 14 is vaporized through the lining 3 and the openings 4 (arrows F) and evacuated from the inside of the rotating cylinder 2 by a pump 16 with funnel 17.

Figure 3:
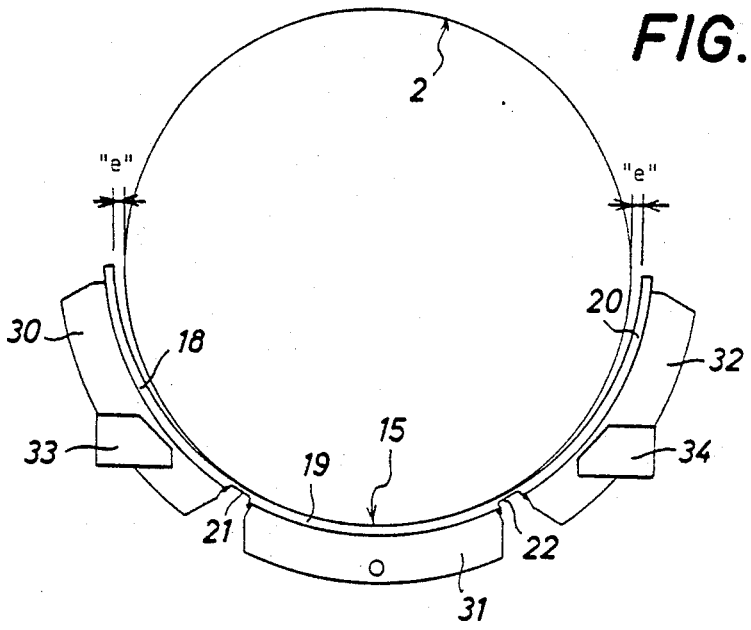
FIG. 3 shows a diagrammatic and simplified side view of the rotating cylinder and the trough of the machine, without compensation of the trough expansion.

As shown in FIG. 3, and already explained, the trough 15 moves at its edges by a gap "e" away from the horizontal diameter of the cylinder 2 when the expansion of the heated trough 15 is not compensated.

In order to get this compensation, and according to the main feature of the invention, the said inner concave and polished surface is that of a rectangular metal plate, such as of boiler-type steel sheet metal (standard NFA 36205, steel A42CP) —which is preferred for its elasticity qualities—which is bent to a radius approximately equal to that of the cylinder 2 with its outer lining 3 when cold, and which is carved on its outside convex surface, by such means as power drilling or milling, with two grooves 21 and 22 (FIGS. 1, 3–11, 16 and 17) running parallel to the bending axis of this plate and dividing the trough 15 into three equal rigid curved sectors 18, 19 and 20 (FIGS. 3–9), the number of which being equal to that of the grooves plus one.

Each of these grooves 21 and 22 provides, by reduction of the thickness of the said plate, an axis of less resistance to the bending of the trough 15 (FIGS. 1, 3–11, 16 and 17).

Figure 4:
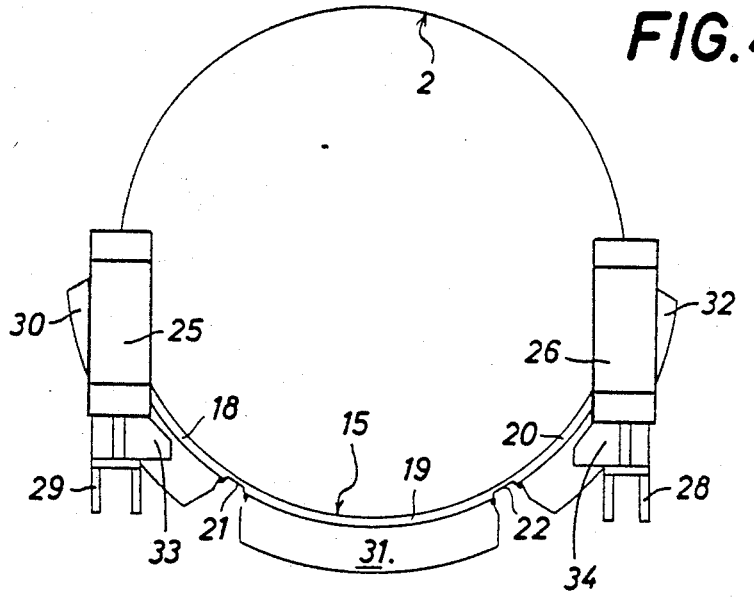
FIG. 4 shows a diagrammatic and simplified side view along the line IV—IV of FIG. 2 of the rotating cylinder and the trough of the machine, with compensation of the trough expansion by the action of the pneumatic jacks.
Figure 5:
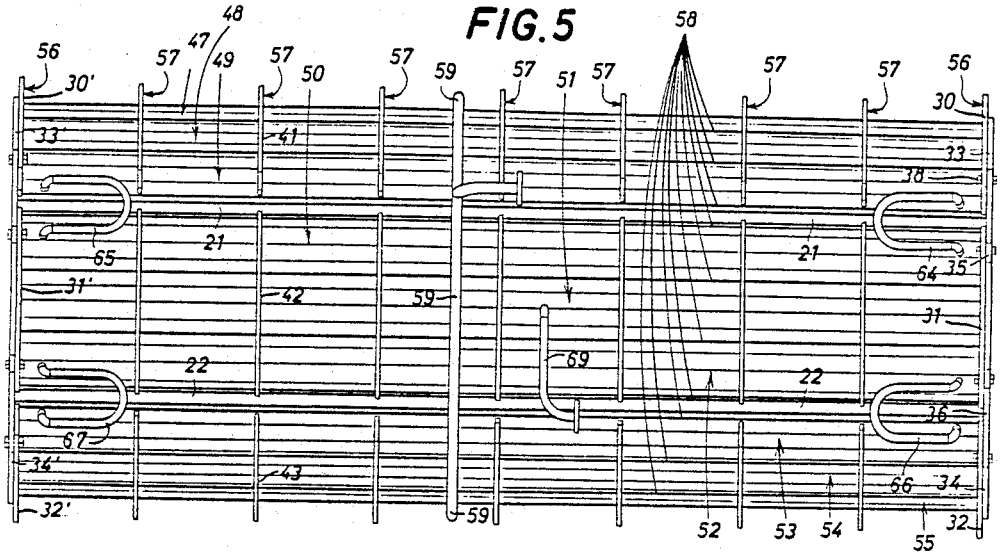
FIG. 5 represents in detail the trough of the machine and its heating systems, as seen from underneath.
Figure 6:
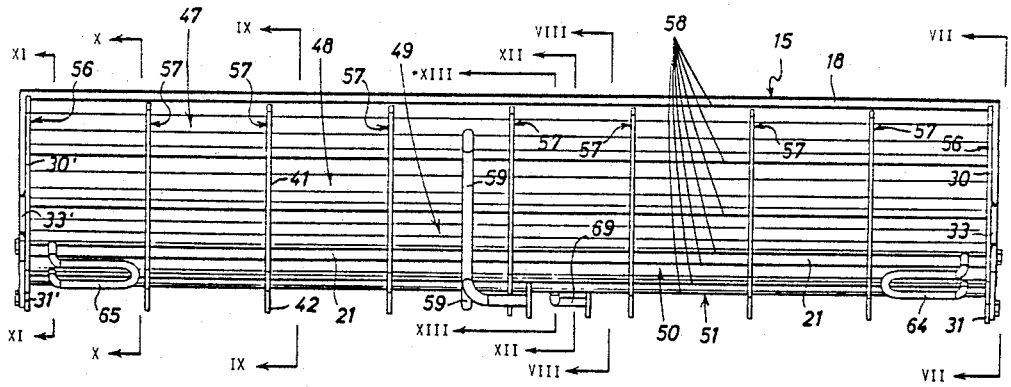
FIG. 6 represents in detail the trough of the machine and its heating systems, as seen from the side.

Adjustable supports of the trough 15 ensure the tight fit of each of the said sectors 18, 19 and 20 (FIGS. 3–9) of the trough 15 against the outer lining 3 of the rotating cylinder 2, as specially shown in FIG. 4, by the slight bending of the trough 15 occurring along each of the said grooves 21 and 22, regardless of the temperature and the expansion of the trough 15.

Figure 2:
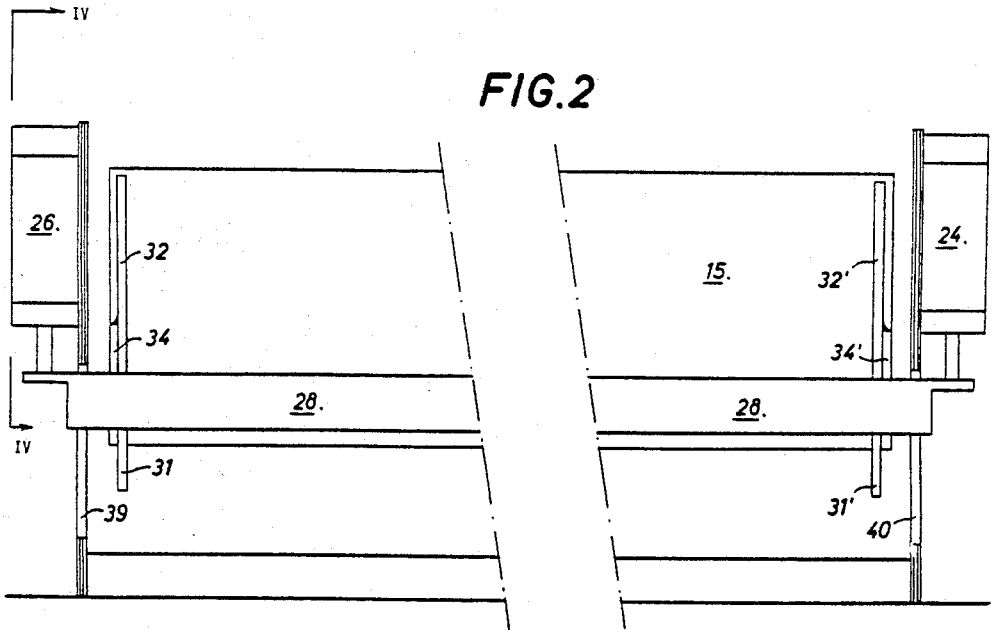
FIG. 2 shows a diagrammatic and simplified front view of the said machine.

Those adjustable supports of the trough 15 are two lateral beams 28 and 29 (FIGS. 1, 2, 4, 7, 8 and 9) located on either side of the trough 15, each one carried at each of its two ends by a pneumatic jack: 23, 24, 25 or 26 (FIGS. 1, 2 and 4), those four pneumatic jacks developing together an adjustable force of about 1650 daN (decanewtons), corresponding to the weight of the trough 15, to 6000 daN. This force permits the bending of the trough 15 so that the distance between its opposite edges is reduced by $2e = 10$ mm, when the maximum force of 6000 daN is applied in bending the s id trough 15 by the four pneumatic jacks 23, 24, 25 and 26.

As shown in FIGS. 1–7, 10 and 11, each end of the three trough sectors 18, 19 and 20 of the trough 15 carries a flat and curvilinear reinforcing bracket 30, 31, 32, respectively 30', 31', 32', fastened over its entire length to the outer convex surface of the said plate, by such means as a continuous weld 90, and positioned so that the overall profile of all reinforcing brackets 30, 31, 32 and 30', 31', 32' of adjacent sectors form at each of the two end of the trough 15 a half rim 56 (FIGS. 5, 6 and 7) bracing this end of the trough 15.

The reinforcing brackets forming a given half rim 56 are advantageously linked by means of a free-travel limiting device which restricts the distance between two contiguous reinforcing brackets within a predetermined range, therefore limiting the length of the half rim 56 and the curvature of the trough 15.

Figure 7:
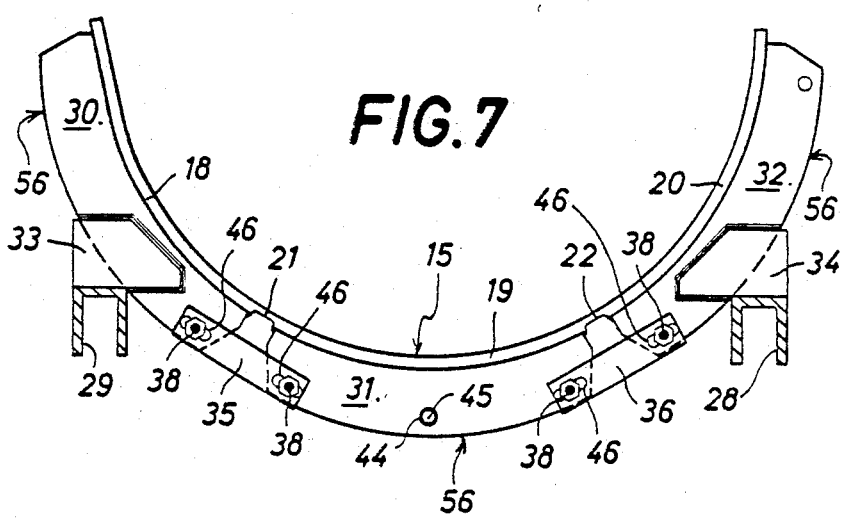
FIGS. 7, 8 and 9 show enlarged front sections of the trough of the machine, taken respectively along the line VII—VII, the line VIII—VIII and the line IX—IX of FIG. 6.
Figure 8:
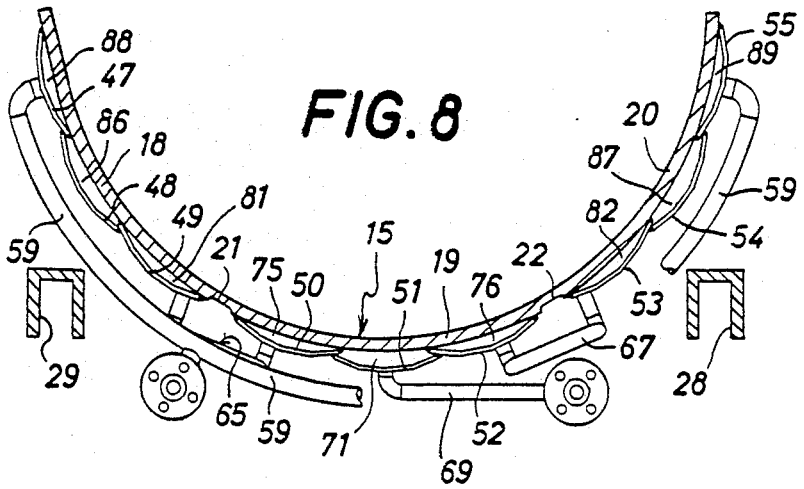

As shown in FIGS. 1 and 7, this limiting device is made of a plate 35 or 36 which links two reinforcing brackets (30 and 31, respectively 31 and 32) by means of pins 38 mounted at each of its ends, which fit and slide freely within slotted holes 46 pierced at the ends of said contiguous reinforcing brackets.

In a variant embodiment (FIGS. 16 and 17), this limiting device may be made of a threaded connecting rod 92 which ends engage in the openings 100 of two shelve angles 93 and 94 mounted face to face on adjacent reinforcing brackets 32 and 31, respectively, the traveling distance between such reinforcing brackets 31, 32, being adjustable by means of two pairs 96, 97 and 98, 99 of lock nuts screwed at the ends of the said threaded connecting rod 92.

As shown in FIGS. 2–4 and 7, the terminal reinforcing brackets of the corresponding ends of the two half rims 56 are provided with shoulder pieces 33, 33'; 34, 34' by which those terminal reinforcing brackets, and consequently the whole trough 15, rest upon the two lateral beams 28 and 29.

Figure 9:
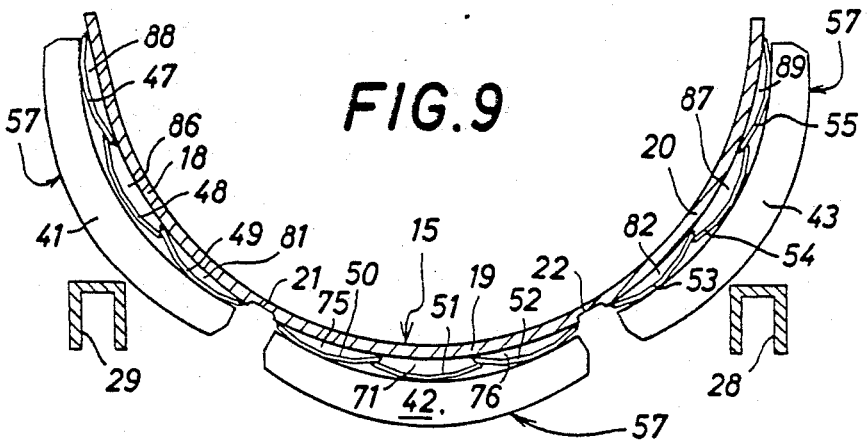
Figure 10:
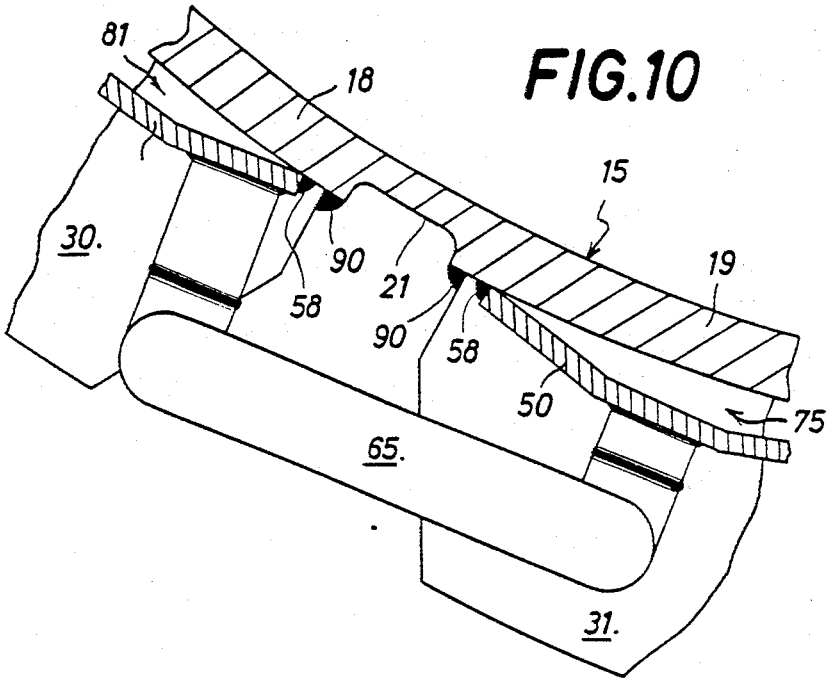
FIGS. 10, 11, 12 and 13 show very enlarged and partial front sections of the trough of the machine, taken respectively along the line X—X, the line XI—XI, the line XII—XII and the line XIII—XIII of FIG. 6.
Figure 11:
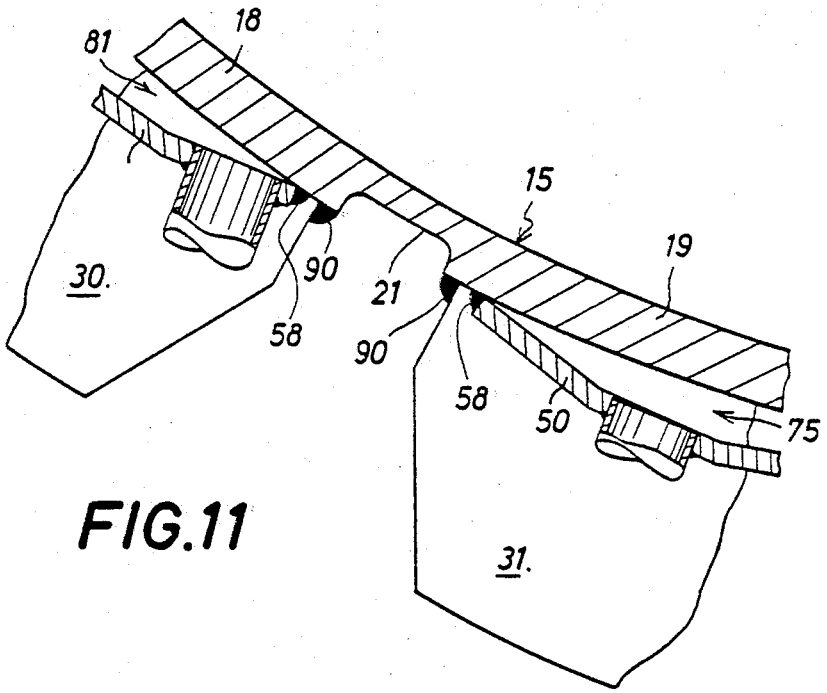
Figure 12:
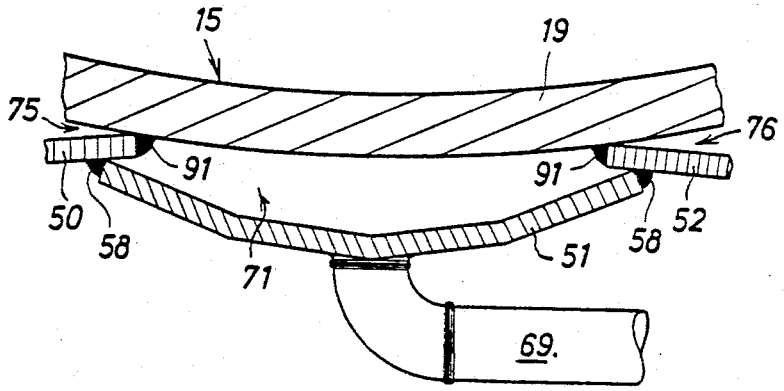
Figure 13:
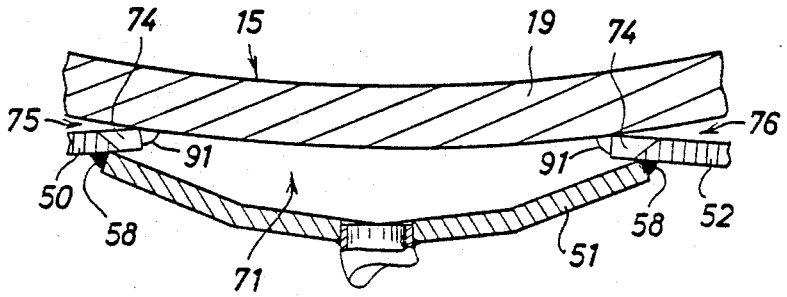
Figure 14:
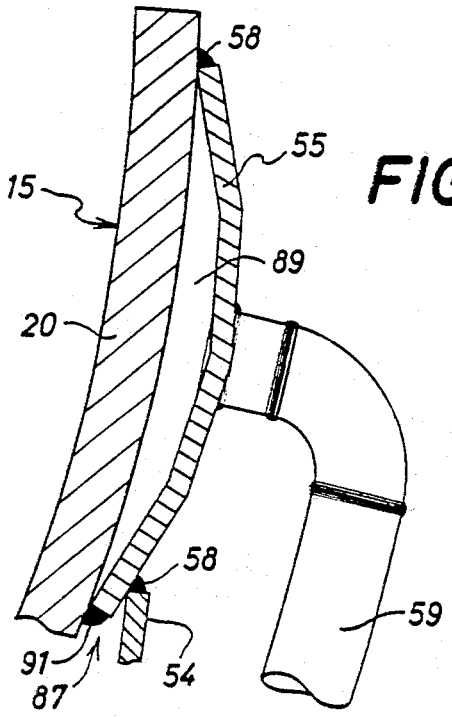
FIG. 14 is an enlarged view of the top right part of FIG. 8, showing in detail a front section of the last heating faceted channel of the right trough sector.
Figure 15:
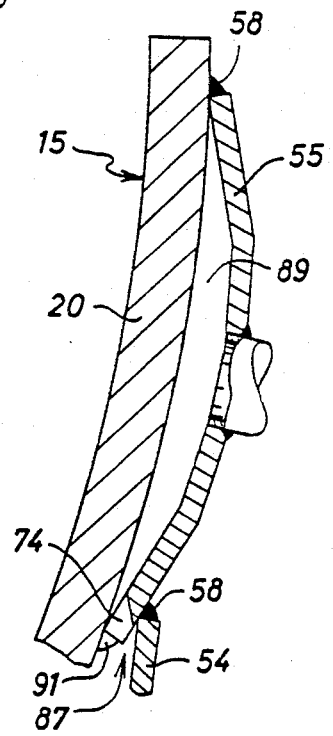
FIG. 15 shows another front section of the same, showing the communication between this heating faceted channel and the adjacent one.
Figure 16:
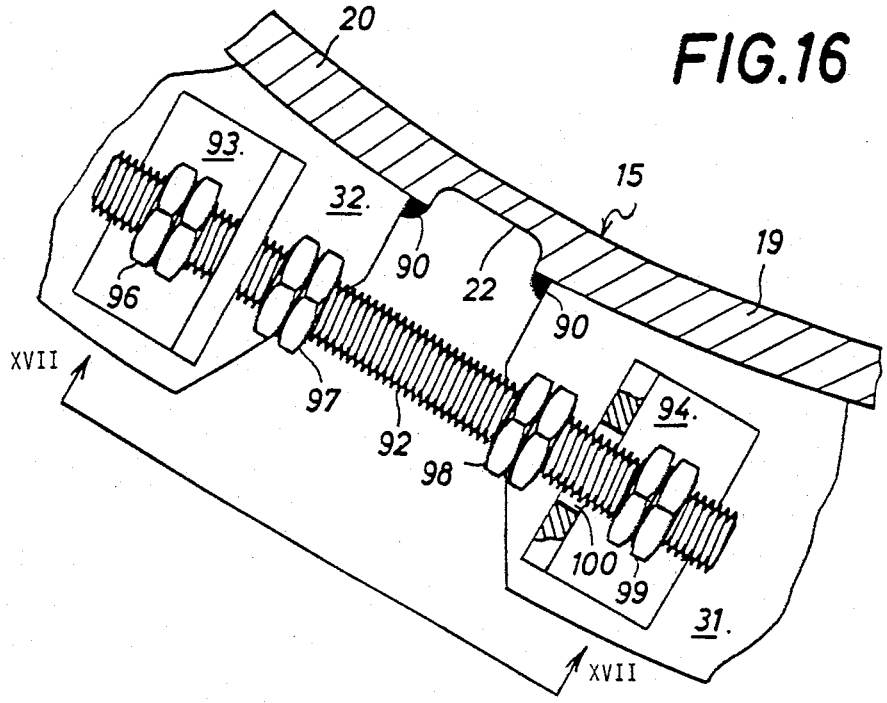
FIGS. 16 and 17 show respectively a front view and an elevation taken along the line XVII—XVII of FIG. 16 of one of the free-travel limiting device featuring a threaded rod.
Figure 17:
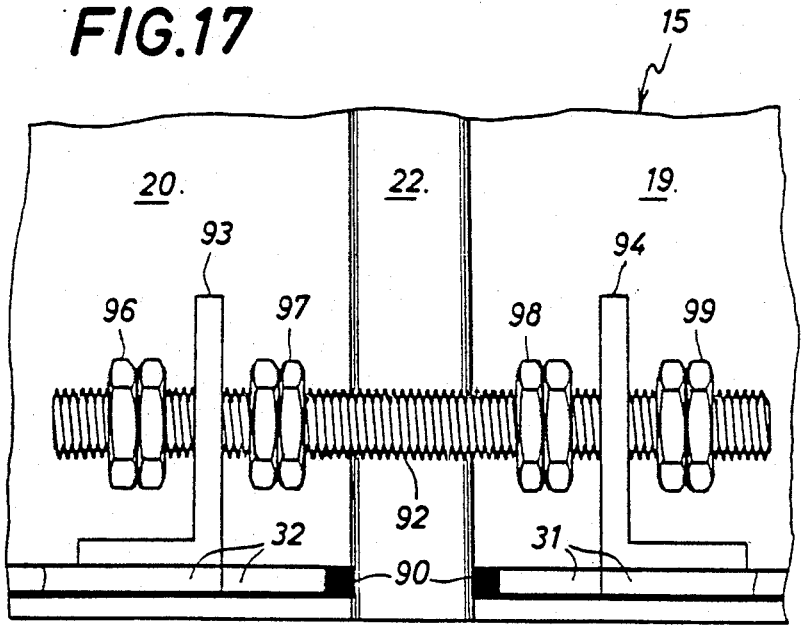

Each sector 18, 19 or 20 of the trough 15 is provided with a fluid circulation system, such as a pressured steam type, made of three faceted channels, respectively 47, 48 and 49; 50, 51 and 52; 53, 54 and 55, enclosing respectively the steam ways 88, 86 and 81; 75, 71 and 76; 82, 87 and 89 as shown in FIGS. 7 and 9, especially.

Those channels overlap sidewise (FIGS. 10–15) so as to communicate with one another through openings 74, and each of them covers and is welded to a portion of the outside surface of one trough sector while fitting, lengthwise, between the two half rims 56 of the trough 15. Welds 58 are shown in FIGS. 10–15.

Advantageously, the heating systems of the three sectors 18, 19 and 20, are connected by means of flexible conduits which can absorb the slack resulting from the bending of the trough 15 along said grooves 21 and 22.

The heating systems of the two outer sectors 18 and 20 are fed, in parallel, with pressured steam by means of a curved supply conduit 59 (FIGS. 8 and 14), and communicate with the heating system of the third or intermediary sector 19 trough by four U-shape conduits 64, 65, 66 and 67 (FIGS. 5, 6, 8 and 10) which are folded back against the back of the trough 15, the steam being evacuated from the latter heating system to a condenser, not shown, through a return conduit 69 (FIGS. 5, 6, 8 and 12).

The said faceted channels which back any given trough sector 18, 19 or 20, are hugged by flat and annular reinforcing brackets 41, 42 or 43 (FIGS. 5, 6 and 9), each welded to the back of the said channel and positioned across the outside face of adjacent trough sectors so that they line up with one another in order to form a segmented half rim 57.

Finally, apertures 39 and 40 are provided into the flanks of the machine in order to lower the trough 15 for cleaning purpose (FIG. 2), and an anti-couple rod 45 retains in angular position the trough 15 of the machine, through an opening 44 provided in the lower reinforcing bracket 31 (FIG. 7).

We claim:

1. In a drying and ironing machine having a rotating cylinder the whole cylindrical surface of which being perforated by a large number of openings and completely wrapped by a sleeve-like elastic and permeable outer lining, at least:

a trough, heated to ironing temperature and against the inner concave and polished surface of which a piece of fabric, drawn by the rotating cylinder and its lining, is applied and simultaneously dried and ironed by friction, said inner concave and polished surface being that of a rectangular metal plate, such as of boiler-type steel sheet metal, which is bent to a radius approximately equal to that of the cylinder with its outer lining when cold, and which is carved on its outside convex surface, by such means as power drilling, with grooves running parallel to the bending axis of this plate and dividing the trough into several equal rigid curved sectors the number of which is equal to that of the grooves plus one, each of these grooves providing, by reduction of the thickness of the said plate, an axis of less resistance to the bending of the trough, and adjustable supports of the trough which ensure the tight fit of each of the said sectors of the trough against the outer lining of the rotating cylinder by the slight bending of the trough occurring along each of the said grooves, regardless of the temperature and the expansion of the trough.

2. The drying and ironing machine of claim 1, wherein each end of the trough sectors carries a flat and curvilinear reinforcing bracket fastened over its entire length to the outer convex surface of the said plate, by such means as a continuous weld, and positioned so that the overall profile of all reinforcing brackets of adjacent sectors form at each of the two ends of the trough a half rim bracing this end of the trough.

3. The drying and ironing machine of claim 2, wherein the reinforcing brackets forming a given half rim are linked by means of a free-travel limiting device which restricts the distance between two contiguous reinforcing brackets within a predetermined range, therefor limiting the length of the half rim and the curvature of the trough.

4. The drying and ironing machine of claim 3, wherein the said free-travel limiting device is made of a plate which links two contiguous reinforcing brackets by means of pins mounted at each of its ends, which fit and slide freely within slotted holes pierced at the ends of said contiguous reinforcing brackets.

5. The drying and ironing machine of claim 3, wherein the said free-travel limiting device is made of a threaded connecting rod which ends engage in the openings of two shelve angles mounted face to face on adjacent reinforcing brackets, the travelling distance between such reinforcing brackets being adjustable by means of two pairs of lock nuts screwed at the ends of the said threaded connecting rod.

6. The drying and ironing machine of claim 2, wherein the adjustable supports of the trough are two lateral beams located on either side of the trough, each one carried at each of its two ends by a pneumatic jack and upon which rest, by means of shoulder pieces, the terminal reinforcing brackets of the corresponding ends of the two half rims.

7. The drying and ironing machine of claim 2, wherein each sector of the trough is provided with a fluid circulation heating system, such as a pressured steam type, made of several faceted channels which overlap sidewise so as to communicate with one another, each of those channels covering and being welded to a portion of the outside surface of one trough sector while fitting, lengthwise, between the two half rims of the trough.

8. The drying and ironing machine of claim 7, wherein the heating systems of the trough sectors are connected by means of flexible conduits which can absorb the slack resulting from the bending of the trough along the said grooves.

9. The drying and ironing machine of claim 7, wherein the faceted channels which back any given trough sector are hugged by flat and annular reinforcing brackets, each welded to the back of the said channels and positioned across the outside face of adjacent trough sectors so that they line up with one another in order to form a segmented half rim.

10. The drying and ironing machine of claim 8, wherein, being understood that the trough of the machine includes only three equal sectors, the heating systems of the two outer sectors of said trough sectors are fed, in parallel, with pressured steam by means of a curved supply conduit, and communicate with the heating system of the third or intermediary sector through four U-shaped conduits which are folded back against the back of the trough, the steam being evacuated from the latter heating system by means of a return conduit.

* * * * *